US009496109B2

(12) United States Patent
Lee

(10) Patent No.: US 9,496,109 B2
(45) Date of Patent: Nov. 15, 2016

(54) ELECTROMAGNETIC RELAY

(71) Applicant: LSIS CO., LTD., Anyang-si, Gyeonggi-do (KR)

(72) Inventor: Kyoung Jun Lee, Uijeongbu-si (KR)

(73) Assignee: LSIS CO., LTD., Anyang-si, Gyeonngi-do (KR)

( * ) Notice: Subject to any disclaimer, the term of this patent is extended or adjusted under 35 U.S.C. 154(b) by 22 days.

(21) Appl. No.: 14/521,123

(22) Filed: Oct. 22, 2014

(65) Prior Publication Data

US 2015/0213980 A1 Jul. 30, 2015

(30) Foreign Application Priority Data

Jan. 27, 2014 (KR) ..... 20-2014-0000611 U

(51) Int. Cl.

| | |
|---|---|
| ***H01H 67/02*** | (2006.01) |
| ***H01H 50/30*** | (2006.01) |
| ***H01H 9/30*** | (2006.01) |
| ***H01H 50/34*** | (2006.01) |
| ***H01H 50/10*** | (2006.01) |

(52) U.S. Cl.

CPC ..... *H01H 50/305* (2013.01); *H01H 9/30* (2013.01); *H01H 50/10* (2013.01); *H01H 50/34* (2013.01)

(58) Field of Classification Search

CPC ..... H01H 51/065
USPC ..... 335/126, 131
See application file for complete search history.

(56) References Cited

U.S. PATENT DOCUMENTS 2,892,059 A * 6/1959 Keirans ..... H01H 51/084 335/122
4,725,801 A * 2/1988 Snyder ..... H01H 51/084 335/122
5,481,236 A * 1/1996 Ruehle ..... H01H 51/065 335/126

(Continued)

FOREIGN PATENT DOCUMENTS

CN 102804315 11/2012
CN 103258689 8/2013

(Continued)

OTHER PUBLICATIONS

Japan Patent Office Application Serial No. 2014-233926, Office Action dated Dec. 8, 2015, 3 pages.

(Continued)

*Primary Examiner* — Alexander Talpalatski
(74) *Attorney, Agent, or Firm* — Lee, Hong, Degerman, Kang & Waimey

(57) ABSTRACT

An electromagnetic relay includes a housing; a fixed contact provided within the housing; a movable contact disposed within the housing so as to be contactable to and separable from the fixed contact; a driving unit configured to drive the movable contact, and including a shaft having one end connected to the movable contact and a compression spring for applying an elastic force to the movable contact so as to be in contact with the fixed contact; and an arc protector including an arc shielding portion for shielding an arc, and a compression spring support portion formed to protrude from the arc shielding portion to support the compression spring, the compression spring support portion comprising a shaft accommodating portion for accommodating the shaft therein. Under such configuration, the number of required components can be reduced and generation of a gap can be prevented.

15 Claims, 10 Drawing Sheets

(56) References Cited

U.S. PATENT DOCUMENTS

| | | | | |
|---|---|---|---|---|
| 7,859,373 | B2 * | 12/2010 | Yamamoto | H01H 50/305 335/126 |
| 7,876,183 | B2 * | 1/2011 | Uruma | H01H 50/04 335/126 |
| 8,354,905 | B2 * | 1/2013 | Eum | H01H 51/065 335/126 |
| 8,674,796 | B2 * | 3/2014 | Ito | H01H 1/20 335/126 |
| 8,766,750 | B2 * | 7/2014 | Choi | H01H 51/065 335/181 |
| 2008/0122562 | A1 | 5/2008 | Bush et al. | |
| 2013/0063232 | A1 | 3/2013 | Takaya et al. | |
| 2013/0214884 | A1 | 8/2013 | Ito et al. | |

FOREIGN PATENT DOCUMENTS

| | | |
|---|---|---|
| EP | 2267746 | 12/2010 |
| EP | 2637190 | 9/2013 |
| JP | 10-326530 | 12/1998 |
| JP | 2006-019148 | 1/2006 |
| WO | 2012/060087 | 5/2012 |

OTHER PUBLICATIONS

European Patent Office Application Serial No. 14190082.9, Search Report dated Jul. 27, 2015, 6 pages.

The State Intellectual Property Office of the People's Republic of China Application Serial No. 201510019167.7, Office Action dated Jul. 11, 2016, 6 pages.

Japan Patent Office Application No. 2014-233926, Notice of Allowance dated Jul. 12, 2016, 4 pages.

* cited by examiner

ELECTROMAGNETIC RELAY

CROSS-REFERENCE TO RELATED APPLICATION

Pursuant to 35 U.S.C. §119(a), this application claims the benefit of earlier filing date and right of priority to Korean Application No. 20-2014-0000611, filed on Jan. 27, 2014, the contents of which is incorporated by reference herein in its entirety.

BACKGROUND OF THE INVENTION

1. Field of the Invention

The present invention relates to an electromagnetic relay, more particularly to an electromagnetic relay which is capable of reducing the number of man-hours in assembling processes.

2. Description of the Conventional Art

As is well known in the art, an electromagnetic relay is a device to open and close a main power supply side circuit and a load side circuit.

FIG. 1 is a sectional view illustrating an electromagnetic relay in accordance with the conventional art, and FIG. 2 is an exploded view illustrating a main part of FIG. 1.

As shown in FIGS. 1 and 2, the conventional electromagnetic relay includes a contact part 10, and a driving part 30 configured to open and close the contact part 10.

The contact part 10 includes a housing 11, a fixed contact 15 fixedly disposed at the housing 11, and a movable contact 21 configured to be in contact with or separated from the fixed contact 15.

The driving part 30 includes a coil 41, a yoke 51 disposed around the coil 41 to form a magnetic path, a fixed core 61 disposed within the coil 41, a movable core 71 disposed to be close to or be separated from the fixed core 61, a shaft 81 having one end connected to the movable core 71 and another end connected to the movable contact 21, and a restoration spring 91 configured to return the movable core 71 to its initial position.

The bobbin 45 is provided within inner, upper and lower sides of the coil 41.

The fixed core 61 is inserted to the bobbin 45.

The fixed core 61 forms a magnetic path together with the yoke 51.

The shaft 81 is inserted into the fixed core 61 so as to be relatively movable with respect to the fixed core 61.

The movable contact 21 is connected to one end of the shaft 81 so as to be relatively movable with respect to the shaft 81.

A compression spring 25, configured to apply pressure against the movable contact 21 to elastically contact with the fixed contact 15, is provided at an end of the shaft 81.

An arc protector 93, configured to protect the components from an arc generated from the fixed contact 15 and the movable contact 21, is provided at a lower inner portion of the housing 11.

The housing 11 is configured to be open at its lower side.

The arc protector 93 is coupled to a lower inner portion of the housing 11 so as to shield the opening portion of the housing 11.

A protrusion 95, configured to accommodate therein the compression spring 25, is provided at a central portion of the protector 93.

A buffering rubber 97 is provided at a lower portion of the compression spring 25.

A washer 98 is disposed on an upper portion of the buffering rubber 97.

However, in such a conventional electromagnetic relay, since the buffering rubber 97 is coupled within the protrusion 95 and the compression spring 25 is disposed on the upper portion of the buffering rubber 97, a gap may be formed at the buffering rubber 97, thereby the elastic support of the compression spring 25 may be inadequate and insufficient.

Further, use of the buffering rubber 97 causes increase in components and as the size of the buffering rubber 97 is relatively small, it is not easy to handle thereof so that a relatively large number of man-hours are required in assembling processes.

SUMMARY OF THE INVENTION

An object of the present invention is to provide an electromagnetic relay which is capable of reducing the number of components and man-hours in assembling processes.

Another object of the present invention is to provide an electromagnetic relay which is capable of restraining generation of a gap between a buffering member and a compression spring.

To achieve these and other advantages and in accordance with the purpose of this specification, as embodied and broadly described herein, there is provided an electromagnetic relay, including a housing; a fixed contact provided within the housing; a movable contact disposed within the housing so as to be in contact with and separated from the fixed contact; a driving unit configured to drive the movable contact, and including a shaft having one end connected to the movable contact and a compression spring for applying an elastic force to the movable contact so as to be in contact with the fixed contact; and an arc protector including an arc shielding portion for shielding an arc, and a compression spring support portion formed to protrude from the arc shielding portion to support the compression spring, the compression spring support portion comprising a shaft accommodating portion for accommodating the shaft therein.

The electromagnetic relay may further include a washer disposed between the compression spring support portion and the compression spring.

The electromagnetic relay may further include a buffer member between the washer and the shaft.

The compression spring support portion may include a plurality of protrusions protruded toward the compression spring.

Each of the protrusions may be configured such that its outer width is gradually decreased toward the compression spring.

Each of the protrusions may be configured to have a triangular cross section.

Each of the protrusions may be configured to have a semicircular cross section.

The driving unit may include a coil; a fixed core disposed within the coil; and a movable core movably disposed to be close to and spaced from the fixed core and having an end connected to the shaft, and wherein the compression spring support portion includes a fixed core accommodating portion to accommodate therein one end of the fixed core.

The fixed core accommodating portion may be configured to extend in a radius direction from the shaft accommodating portion.

The arc shielding portion may include a bottom portion and a side wall portion formed to protrude along a peripheral portion of the bottom portion.

The side wall portion may be tightly fitted into an inner surface of the housing.

The compression spring support portion may include a guiding portion disposed at an outer side of the compression spring.

The guiding portion may include a washer accommodating portion to accommodate therein the washer.

The compression spring support portion may include a cylindrical portion having the shaft accommodating portion therein, and the guiding portion may be configured to protrude from the cylindrical portion and to have an extended inner diameter than the cylindrical portion.

The guiding portion may include a plurality of protrusions formed to protrude from the cylindrical portion and configured to support the washer.

Each of the protrusions may be configured to have a triangular cross section.

Each of the protrusions may be configured to have a semicircular cross section.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE PREFERRED EMBODIMENT

Hereinafter, a preferred embodiment of an electromagnetic relay according to the present invention will be described in detail with reference to the accompanying drawings.

Figure 1:
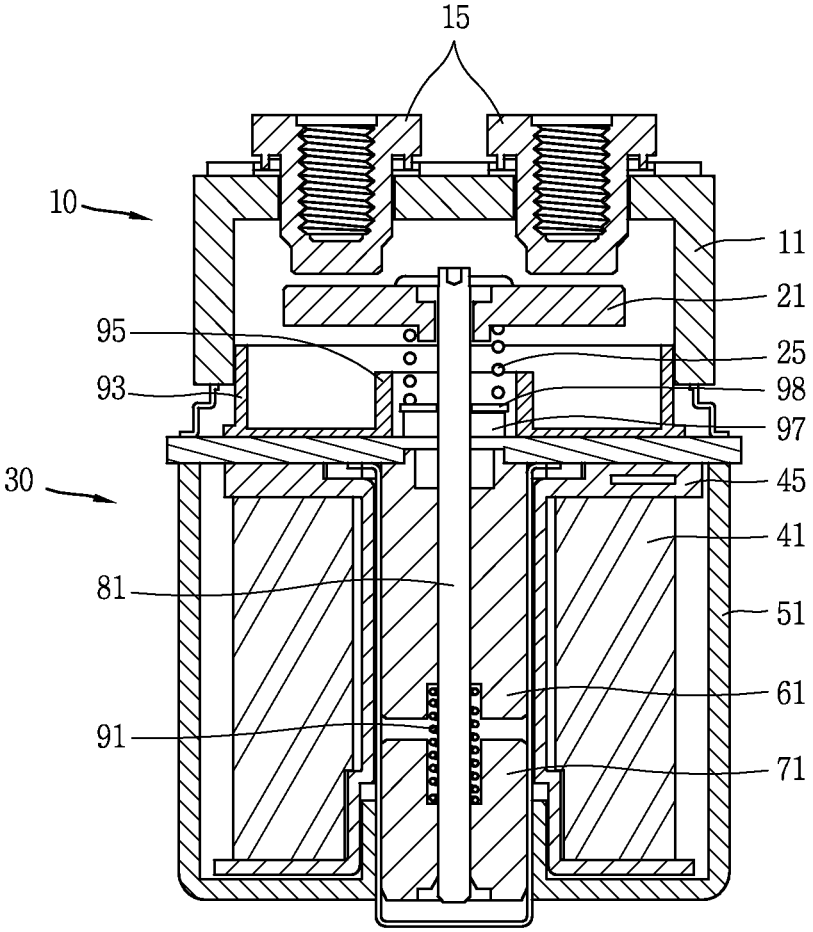
FIG. 1 RELATED ART
FIG. 1 is a sectional view illustrating an electromagnetic relay in accordance with the conventional art.
Figure 2:
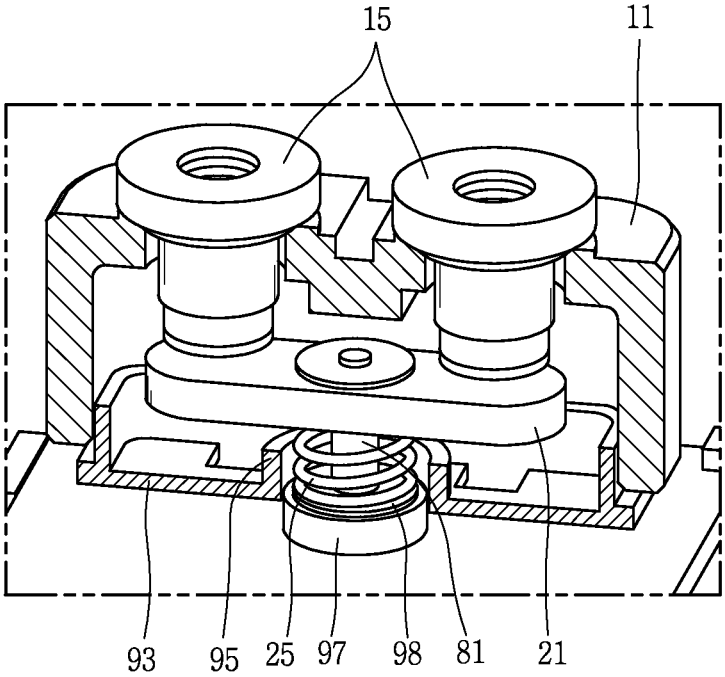
FIG. 2 RELATED ART
FIG. 2 is an enlarged view of a main part of the electromagnetic relay in accordance with the conventional art.
Figure 3:
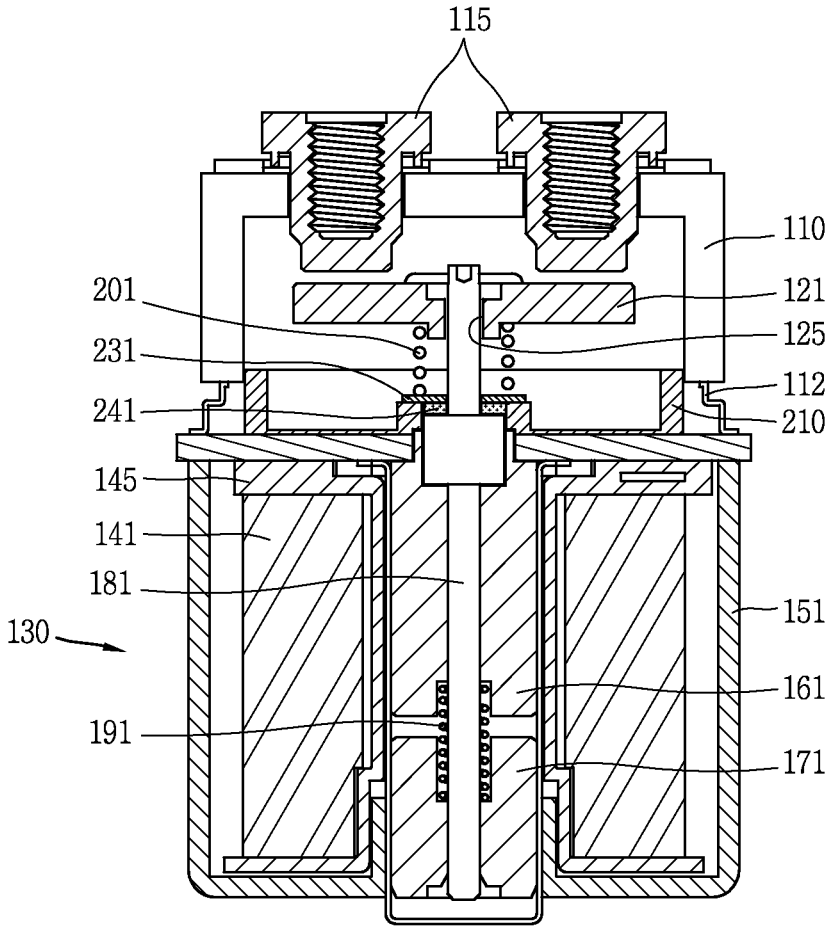
FIG. 3 is a sectional view illustrating an electromagnetic relay in accordance with an embodiment of the present invention.
Figure 4:
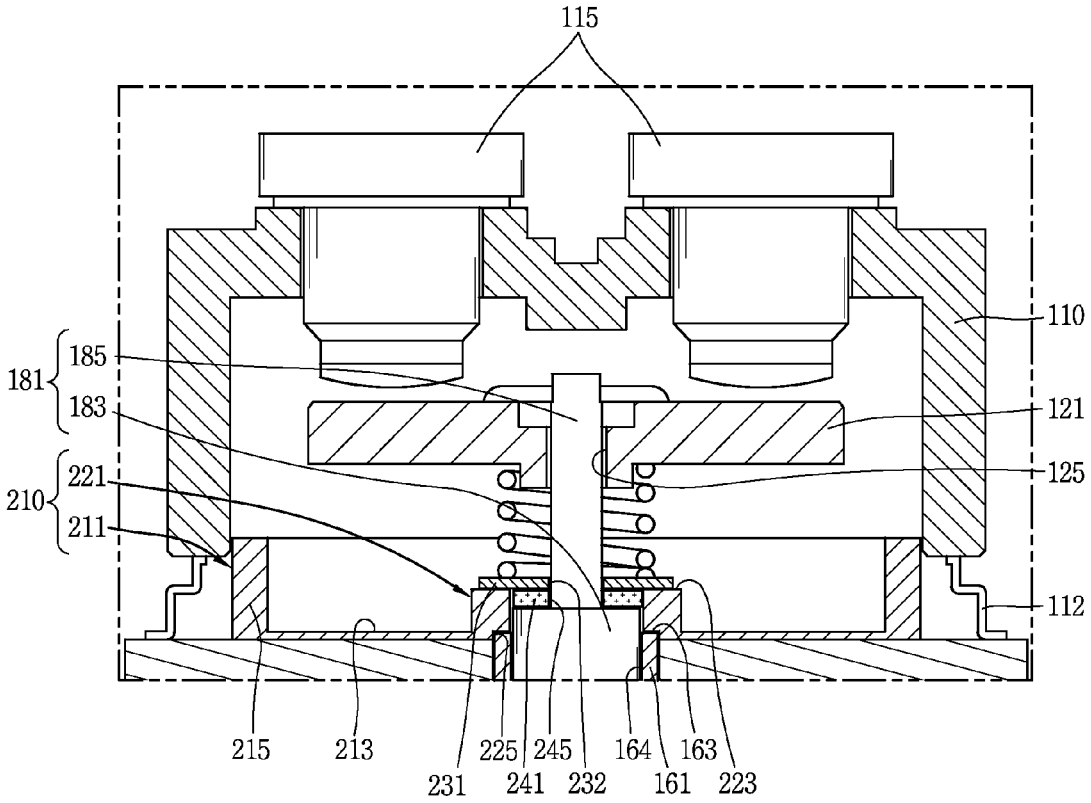
FIG. 4 is an enlarged view illustrating an arc protector of FIG. 3.
Figure 5:
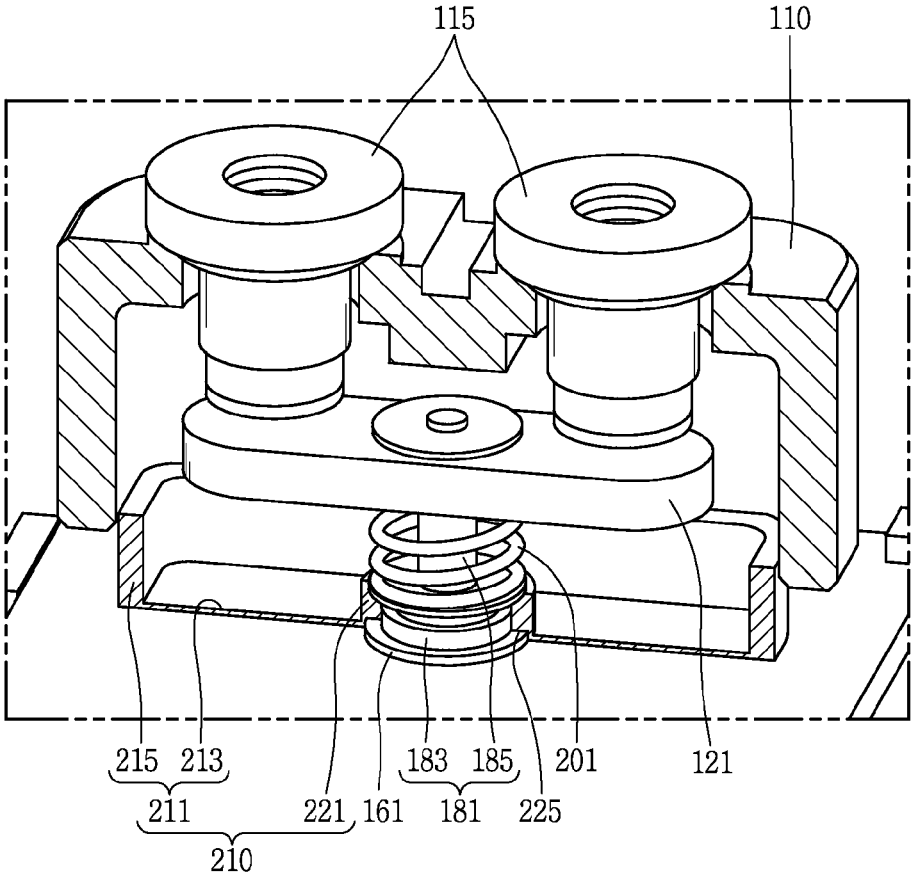
FIG. 5 is a partially cut-out perspective view illustrating the arc protector of FIG. 4.
Figure 6:
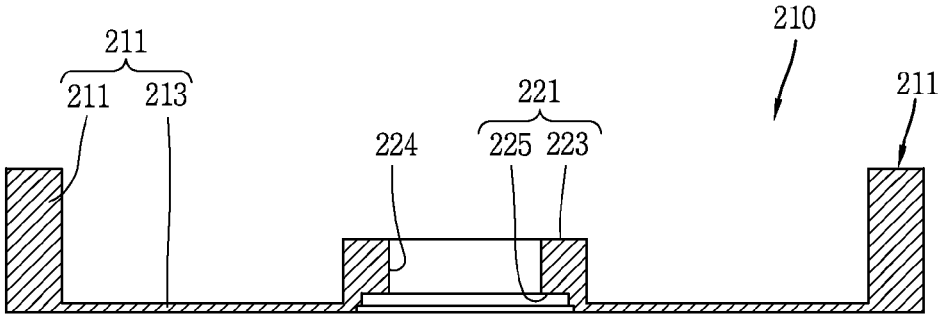
FIG. 6 is an enlarged view illustrating the arc protector of FIG. 3.

As shown in FIGS. 3 and 4, an electromagnetic relay according to an embodiment of the present invention may include a housing 110; a fixed contact 115 provided within the housing 110; a movable contact 121 disposed within the housing 110 so as to be in contact with and separated from the fixed contact 115; a driving unit 130 configured to drive the movable contact 121 and including a shaft 181 having one end connected to the movable contact 121 and a compression spring 201 for applying an elastic force to the movable contact 121 so as to be in contact with the fixed contact 115; and an arc protector 210 including an arc shielding portion 211 for shielding an arc and a compression spring support portion 221 formed to protrude from the arc shielding portion 211 to support the compression spring 201.

The housing 110 may have an accommodating space therein.

The housing 110 may be formed of a ceramic material.

The housing 110 may be formed to be open at its lower part.

The fixed contact 115 may be provided within the housing 110.

The fixed contact 115 may be coupled to an upper end of the housing 110.

The movable contact 121, configured to be in contact with and separated from the fixed contact 115, may be provided within the housing 110.

The driving unit 130, configured to drive the movable contact 121 so as to be in contact with and separated from the fixed contact 115, may be provided at one side of the housing 110.

The driving unit 130 may be disposed at a lower side of the housing 110.

The driving unit 130 may include a coil 141 configured to generate an electromagnetic force, a yoke 151 disposed around the coil 141 to form a magnetic path, a fixed core 161 disposed within the coil 141, a movable core 171 movably disposed to be close to and spaced from the fixed core 161, a shaft 181 having one end connected to the movable core 171 and another end connected to the movable contact 121, and a restoration spring 191 configured to apply an elastic force to the movable core 171 so as to be spaced from the fixed core 161.

The coil 141 may be formed in a cylindrical shape.

The bobbin 145 may be provided within the coil 141.

The fixed core 161 and the movable core 171 may be inserted into the bobbin 145.

A restoration spring 191 may be provided between the fixed core 161 and the movable core 171 to apply an elastic force thereto so that the fixed core 161 and the movable core 171 may be spaced from each other.

An upper end of the fixed core 161 may be configured to protrude toward an upper side of the yoke 151 at a predetermined height.

An accommodating portion 164 may be provided within the fixed core 161 so that the shaft 181 may be accommodated and relatively movable therein.

The movable contact 121 may be formed of an electrically-conductive material.

An end of the shaft 181 may be connected to the movable contact 121 so as to be relative movable.

An insertion hole 125 may be provided on the movable contact 121 so that an end of the shaft 181 may be inserted and relatively movable therein.

The shaft 181 may include a shaft body 183 and a movable contact coupling portion 185 formed to protrude from one side of the shaft body 183 and to be in connect with the movable contact 121.

The shaft body 183 may be accommodated and coupled to the accommodating portion 164 of the fixed core 161.

The movable contact coupling portion 185 may have a smaller outer diameter than the shaft body 183.

The movable contact coupling portion 185 may be inserted and coupled to the insertion hole 125 of the movable contact 121.

The compression spring 201, configured to apply an elastic force to the movable contact 121 so as to be in elastically contact with the fixed contact 115 with a predetermined pressure, may be provided at one side of the movable contact 121.

The compression spring 201 may be implemented by a compression coil spring.

An end of the shaft 181 may be inserted and coupled within the compression spring 201.

The movable contact coupling portion 185 may be inserted into the compression spring 201.

The arc protector 210 may be provided at a lower side of the movable contact 121.

The arc protector 210 may be provided at a lower opening portion of the housing 110.

A seal cup 112 may be provided at an outer peripheral surface of the arc protector 210.

The arc protector 210 may include an arc shielding portion 211 configured to protect the driving unit 130 from an arc generated by the fixed contact 115 and the movable contact 121; and a compression spring support portion 221 formed at a central part of the arc shielding portion 211 and configured to support the compression spring 201.

The arc protector 210 may be formed of a material exhibiting an electric insulation and an impact buffering performance.

The arc protector 210 may be formed of rubber.

The arc shielding portion 211 may include a bottom portion 213 and a side wall portion 215 protruded from a peripheral edge of the bottom portion 213.

The side wall portion 215 of the arc shielding portion 211 may be configured to be inserted into the housing 110.

The side wall portion 215 of the arc shielding portion 211 may be configured to be in surface-contact with an inner surface of the housing 110.

The side wall portion 215 of the arc shielding portion 211 may be configured to be tight-fitted into the housing 110 at its upper peripheral flange portion. Under such a configuration, leakage of an arc generated between the fixed contact 115 and the movable contact 121 can be prevented.

A compression spring support portion 221 may be provided at a central portion of the arc shielding portion 211.

The compression spring support portion 221 may be formed to protrude from the bottom portion 213 of the arc shielding portion 211.

The compression spring support portion 221 may be formed to have a cylindrical shape to accommodate therein the shaft 181.

The compression spring support portion 221 includes a shaft accommodating portion 224 for accommodating the shaft 181 therein.

The compression spring support portion 221 may be configured to protrude over an upper end of the shaft body 183 in an initial position where the movable contact 121 is spaced from the fixed contact 115.

The compression spring support portion 221 may include a fixed core accommodating portion 225 at its lower part to accommodate therein an upper end 163 of the fixed core 161. Under such a configuration, the arc protector 210 can be fixedly coupled.

More specifically, the arc protector 210 can be firmly coupled without any lateral movement due to such a configuration that the side wall portion 215 of the arc shielding portion 211 is tight-fitted into the housing 110, and the fixed core accommodating portion 225 of the compression spring support portion 225 of the arc shielding portion 211 is coupled with the upper portion 163 of the fixed core 161.

The fixed core accommodating portion 225 may be provided at a lower part of the compression spring support portion 221.

The fixed core accommodating portion 225 may be formed by cutting out part of the compression spring support portion 221 to extend outward in a radius direction.

An upper end 223 of the compression spring support portion 221 may be configured to be a flat surface.

A washer 201 may be provided between the upper end 223 of the compression spring support portion 221 and the compression spring 201.

The movable contact coupling portion 185 may be accommodated and coupled to a through-hole 232 of the washer 231.

The compression spring support portion 221 may be configured to have an outer diameter larger than those of the washer 231 and the compression spring 201.

The washer 231 may surface-contact with the upper end 223 of the compression spring support portion 221.

A buffering member 241 may be provided between the washer 231 and the shaft 181. Under such a configuration, a direct contact of the washer 231 and the shaft 181 may be avoided, and thus it is possible to prevent noise which may be generated by a contact between metal members.

The buffer member 241 may be configured to have a disk shape.

The buffer member 241 may be configured to have an outer diameter smaller than an inner diameter of the compression spring support portion 221.

The buffer member 241 may include, at a central portion thereof, a through-hole 245 through which the shaft 181 passes.

More specifically, an inner diameter of the through-hole 245 may be larger than an outer diameter of the movable contact coupling portion 185.

Figure 7:
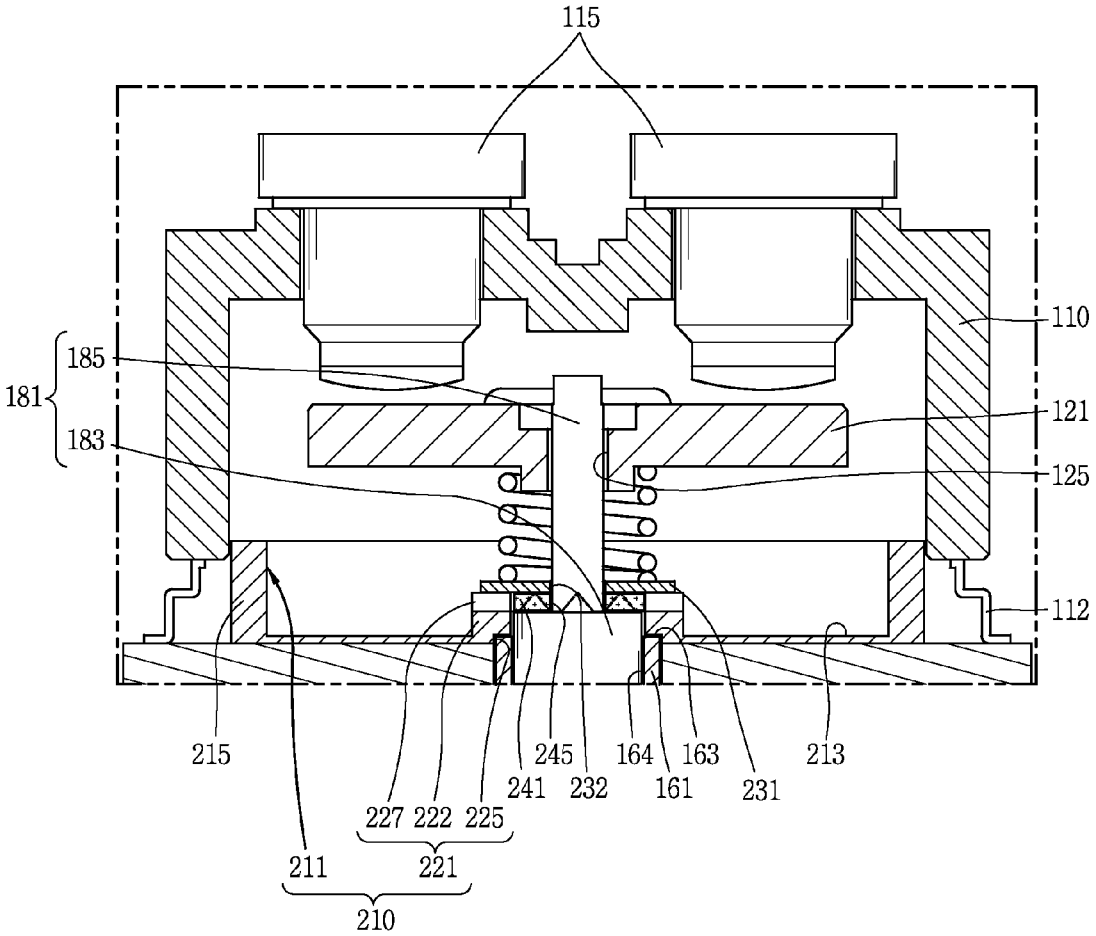
FIG. 7 is a sectional view illustrating another example of the arc protector of FIG. 3.
Figure 8:
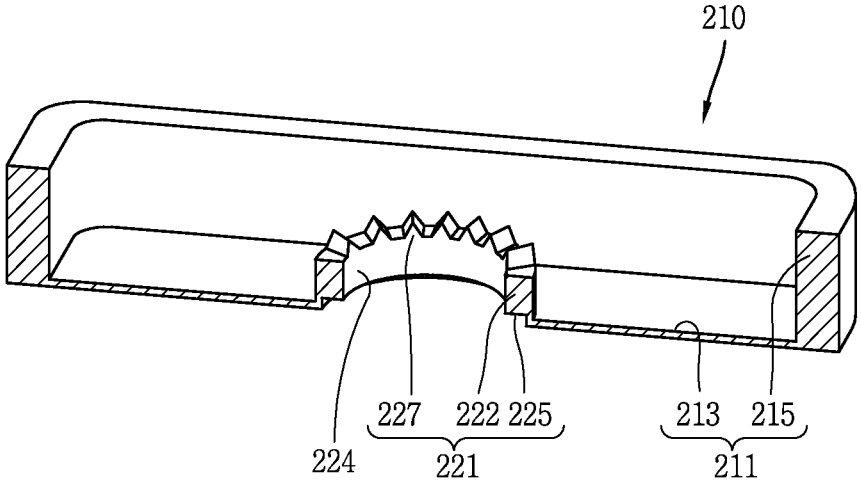
FIG. 8 is a partially cut-out perspective view illustrating the arc protector of FIG. 7.

As shown in FIGS. 7 and 8, the arc protector 210 may include a plurality of protrusions 227 which are protruded toward the compression spring 201.

The arc protector 210 may include the arc shielding portion 211; and the compression spring support portion 221 configured to support the compression spring 201, and formed at a center portion of the arc shielding portion 211 to protrude toward the compression spring 201.

The compression spring support portion 221 may include the cylindrical portion 222 formed to protrude from the bottom portion 213 of the arc shielding portion 211 in a cylindrical shape, and a plurality of protrusions 227 which are formed at an upper edge of the cylindrical portion 222 to protrude toward the compression spring 201 and spaced from each other in a circumferential direction.

The cylindrical portion 222 may include a fixed core accommodating portion 225 configured to accommodate therein an upper portion 163 of the fixed core 161.

Each of the protrusions 227 may be configured such that its outer width is gradually decreased toward the compression spring 201. Under such a configuration, in an initial contact state between the protrusions 227 and the washer 231, buffering is performed therebetween, thereby restraining generation of noise.

The washer 231 may be provided at an upper side of the protrusions 227.

The protrusions 227 may be configured to have a triangular shape.

Figure 11:
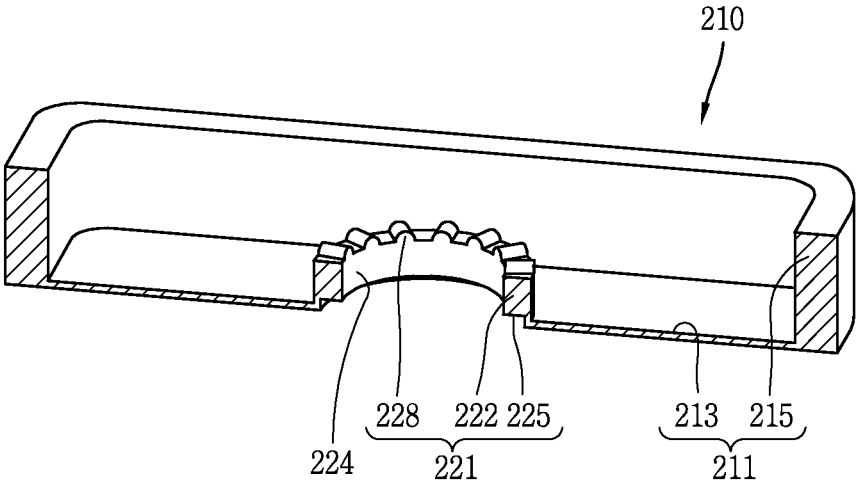
FIG. 11 is a sectional view illustrating another example of the protrusion of FIG. 7.

In this embodiment of the present invention, the protrusions 227 are formed in a triangular shape, but may be configured to have a semicircular shaped cross section, as shown in FIG. 11.

Figure 9:
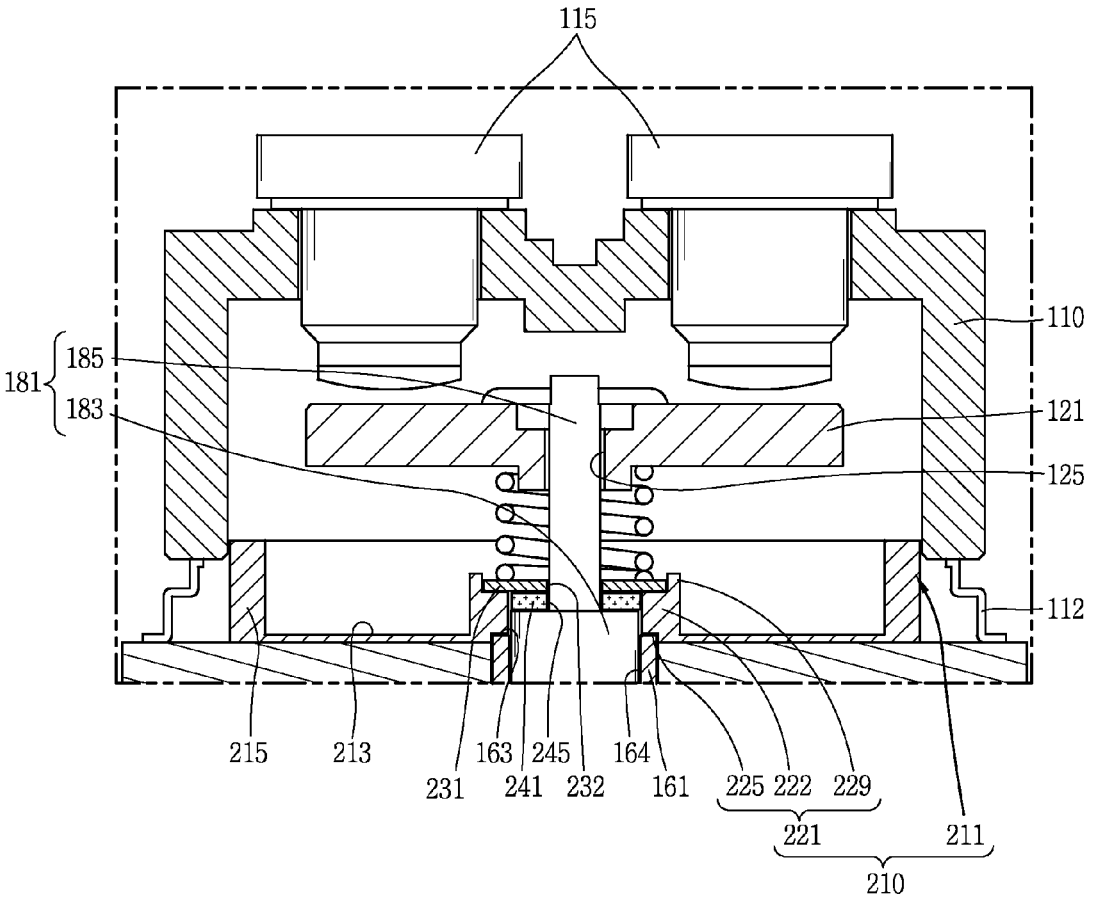
FIG. 9 is a sectional view illustrating another example of the arc protector of FIG. 3.
Figure 10:
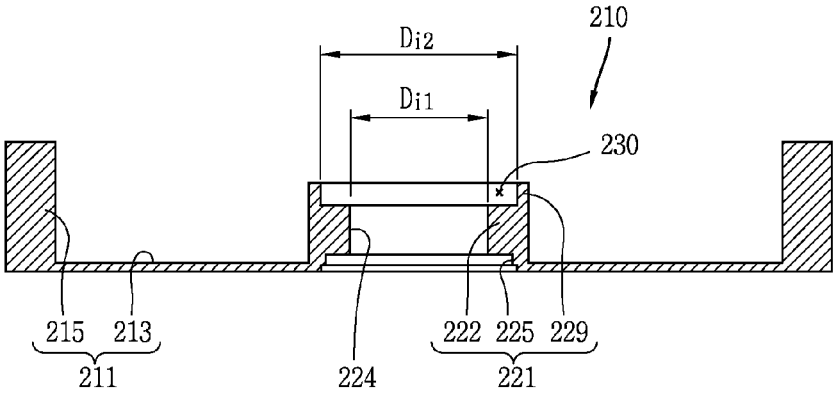
FIG. 10 is an enlarged view illustrating the arc protector of FIG. 9.

As shown in FIGS. 9 and 10, the arc protector 210 may include a guiding portion 229 disposed at an outer peripheral portion of the compression spring 201.

The arc protector 210 may include an arc shielding portion 211, and a compression spring support portion 221 provided at a central part thereof to protrude toward the compression spring 201 and configured to support the compression spring 201.

The compression spring support portion 221 may include a cylindrical portion 222 formed to protrude from the bottom portion 213 of the arc shielding portion 211 in a cylindrical shape, and the guiding portion 229 disposed at an outer peripheral portion of the compression spring 201 to protrude from an upper end of the cylindrical portion 222.

The guiding portion 222 may be configured to have a cylindrical shape which is protruded from the upper end of the cylindrical portion 222 toward the movable contact 121 and extended along a circumferential direction in a cylindrical shape.

The cylindrical portion 222 may include the fixed core accommodating portion 225 in which an upper end of the fixed core 161 is accommodated.

The guiding portion 229 may be configured to have an enlarged inner diameter Di2, when compared with an inner diameter Di1 of the cylindrical portion 222.

A washer accommodating portion 230 may be provided in the guiding portion 229 to accommodate therein the washer 231.

The washer 231 may be disposed on an upper portion of the cylindrical portion 222.

Figure 12:
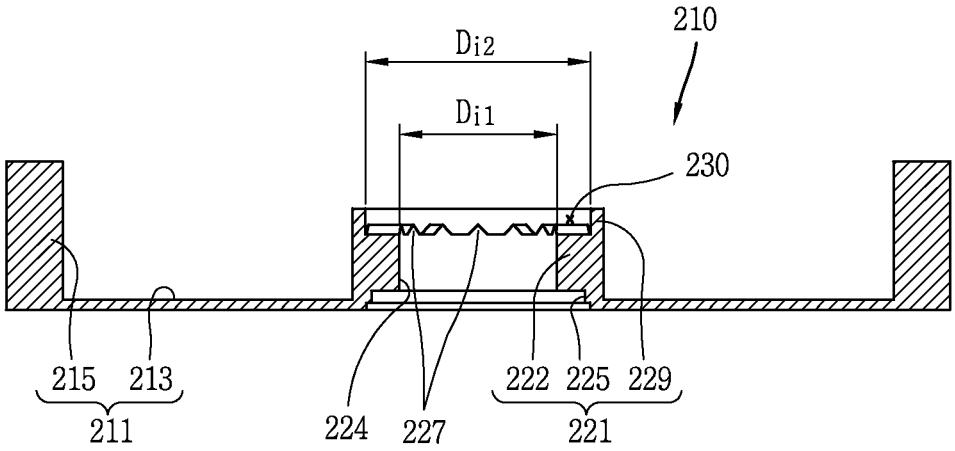
FIGS. 12 and 13 are sectional views illustrating another example of the arc protector of FIG. 3, respectively.

As shown in FIG. 12, the cylindrical portion 222 may have a plurality of triangle protrusions 227 at its upper peripheral edge. Under such a configuration, a contact area between the washer 231 and the protrusions 227 in an initial contact state may be relatively small and a buffering may be easily performed, thereby reducing noise.

Figure 13:
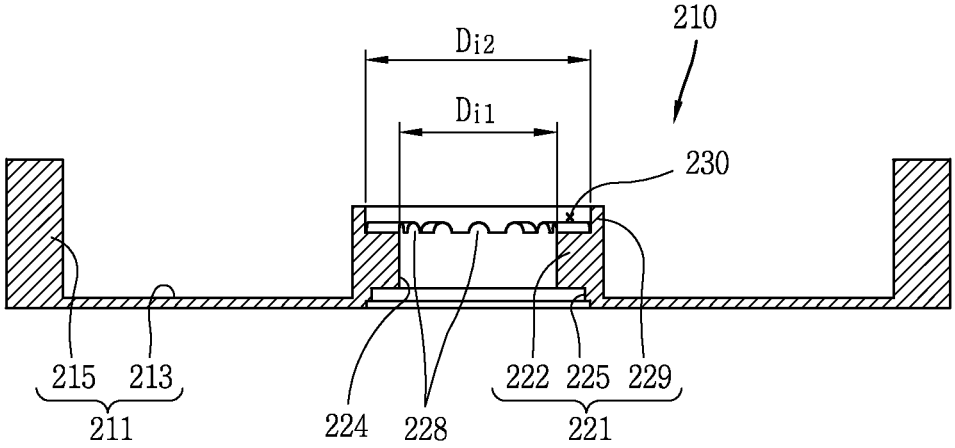

As shown in FIG. 13, the cylindrical portion 222 may include a plurality of protrusions 228 having a semicircular cross section. Under such a configuration, a contact area between the washer 231 and the protrusions 228 in an initial contact state may be relatively small and a buffering may be easily performed, thereby reducing noise.

Under such a configuration, the arc protector 210 may be coupled such that an upper end of the fixed core 161 protruded toward an upper portion of the yoke 151 is accommodated within the fixed core accommodating portion 225.

The shaft 181 may be pre-assembled with the buffer member 241, the washer 231, the compression spring 201, and the movable contact 121.

The lower end of the shaft 181 may be inserted into and coupled with the fixed core 161.

The lower end of the shaft 181 may be inserted into inside of the movable core 171 and integrally coupled thereto. For instance, the lower end of the shaft 181 may be coupled to the movable core 171 by welding.

The housing 110 may be coupled to the upper portion of the arc protector 210.

Meanwhile, when a power is applied to the coil 141 of the driving unit 30, the movable core 171 is moved toward the fixed core 161 by an electromagnetic force generated therebetween.

The shaft 181 and the movable core 121 may be moved toward the fixed contact 115 at the same time when the movable core 171 moves. At this moment, the restoration spring 191 is compressed to accumulate an elastic force.

The movable contact 121 which has been moved may contact the fixed contact 115 and thereafter stop moving.

An arc may be generated when the movable contact 121 and the fixed contact 115 are in contact with each other and/or separated from each other, and the arc generated therebetween can be prevented from being scattered to the periphery by the arc protector 210.

The shaft 181 and the movable core 171 may be moved relative to the movable contact 121 until the movable core 171 contacts the fixed core 161. At this moment, the compression spring 201 is compressed to accumulate an elastic force.

More specifically, once the movable contact 121 stops its movement after the movable contact 121 contacts the fixed contact 115, the washer 231 may be compressed by the shaft 181 and then spaced from the compression spring support portion 221. As the washer 231 is moved, the compression spring 201 is compressed to accumulate an elastic force. Thus, the movable contact 121 may stably contact the fixed contact 115 with a predetermined compression force.

Meanwhile, when a power supply to the coil 141 of the driving unit 130 is stopped, the movable core 171 may be spaced from the fixed core 161 by the elastic force of the restoration spring 191 and then returns to its initial position.

When the movable core 171 is moved, the shaft 181 may return to its initial position. As the shaft 181 moves, the compression spring 201 may be elongated.

When the compression spring 201 starts to be elongated, the washer 231 may be moved toward the compression spring support portion 221.

At this moment, the washer 231 may be buffered by the buffer member 241 or the protrusions 227 and 228, thereby restraining generation of noise.

As described above, according to an embodiment of the present invention, the number of the components and manhours can be reduced by providing the arc protector including the arc shielding portion and the compression spring support portion.

Further, both arc protection and buffering and support of the compression spring can be implemented with a single component, by providing the spring support portion and the arc shielding portion which are formed integrally.

Further, the compression spring can be stably supported without generating a gap of the compression spring support portion, by providing the spring support portion and the arc shielding portion which are formed integrally.

Further, the outer peripheral and central portions of the arc protector can be firmly supported, by providing the fixed core accommodating portion at the compression spring support portion.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electromagnetic relay, comprising:

a housing;

a fixed contact provided within the housing;

a movable contact disposed within the housing and configured to be movable between contacting the fixed contact and separated from the fixed contact;

a driving unit configured to drive the movable contact, and including a shaft having one end connected to the movable contact and a compression spring for applying an elastic force to the movable contact so as to be in contact with the fixed contact; and an arc protector including an arc shielding portion for shielding an arc, and a compression spring support portion formed to protrude from the arc shielding portion to support the compression spring, the compression spring support portion comprising a shaft accommodating portion for accommodating the shaft therein, wherein the compression spring support portion includes a plurality of protrusions protruding toward the compression spring, and wherein each of the protrusions is configured such that its outer width is gradually decreased toward the compression spring.

2. The electromagnetic relay of claim 1, further comprising a washer disposed between the compression spring support portion and the compression spring.

3. The electromagnetic relay of claim 2, further comprising a buffer member disposed between the washer and the shaft.

4. The electromagnetic relay of claim 1, wherein each of the protrusions has a triangular cross section.

5. The electromagnetic relay of claim 1, wherein each of the protrusions has a semicircular cross section.

6. The electromagnetic relay of claim 1, wherein the driving unit further comprises:

a coil;

a fixed core disposed within the coil; and a movable core configured to be moveable between a first position proximate to the fixed core to a second position away from the fixed core and having an end connected to the shaft, wherein the compression spring support portion includes a fixed core accommodating portion to accommodate therein one end of the fixed core.

7. The electromagnetic relay of claim 6, wherein the fixed core accommodating portion is configured to extend in a radial direction from the shaft accommodating portion.

8. The electromagnetic relay of claim 6, wherein:

the arc shielding portion comprises a bottom portion and a side wall portion configured to protrude from a peripheral portion of the bottom portion, and the side wall portion is disposed within the housing.

9. The electromagnetic relay of claim 8, wherein the side wall portion is disposed within the housing such that an outer surface of the side wall portion and an inner surface of the housing are in contact.

10. The electromagnetic relay of claim 2, wherein the compression support portion includes a guiding portion disposed at an outer side of the compression spring.

11. The electromagnetic relay of claim 10, wherein the guiding portion includes a washer accommodating portion to accommodate therein the washer.

12. The electromagnetic relay of claim 11, wherein the compression spring support portion includes a cylindrical portion having the shaft accommodating portion therein, and wherein the guiding portion is configured to protrude from the cylindrical portion and has an inner diameter larger than an inner diameter of the cylindrical portion.

13. The electromagnetic relay of claim 12, wherein the guiding portion includes a plurality of protrusions configured to protrude from the cylindrical portion and support the washer.

14. The electromagnetic relay of claim 13, wherein each of the protrusions is configured to have a triangular cross section.

15. The electromagnetic relay of claim 13, wherein each of the protrusions is configured to have a semicircular cross section.

* * * * *